US012042113B2

(12) United States Patent
Durham et al.

(10) Patent No.: US 12,042,113 B2
(45) Date of Patent: Jul. 23, 2024

(54) FLAGGED WATER EVENT RESPONSE CYCLE RESUME FOR A DISHWASHER APPLIANCE

(71) Applicant: Haier US Appliance Solutions, Inc., Wilmington, DE (US)

(72) Inventors: Kyle Edward Durham, Louisville, KY (US); Adam Christopher Hofmann, Louisville, KY (US); Christopher Brandon Ross, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 93 days.

(21) Appl. No.: 17/884,685

(22) Filed: Aug. 10, 2022

(65) Prior Publication Data

US 2024/0049941 A1 Feb. 15, 2024

(51) Int. Cl.
*A47L 15/42* (2006.01)
*A47L 15/46* (2006.01)

(52) U.S. Cl.
CPC ..... *A47L 15/4244* (2013.01); *A47L 15/46* (2013.01); *A47L 2501/05* (2013.01); *A47L 2501/26* (2013.01)

(58) Field of Classification Search
CPC ..... D06F 39/125
See application file for complete search history.

(56) References Cited

U.S. PATENT DOCUMENTS

| | | | |
|---|---|---|---|
| 9,737,190 | B2 | 8/2017 | Mersch |
| 11,234,576 | B2 | 2/2022 | Durham et al. |
| 2009/0266442 | A1 | 10/2009 | Duscher et al. |
| 2010/0275954 | A1 | 11/2010 | Walter et al. |
| 2012/0111372 | A1 | 5/2012 | Hesterberg et al. |
| 2012/0125369 | A1 | 5/2012 | Pers et al. |
| 2013/0008477 | A1 | 1/2013 | Forst et al. |
| 2014/0360530 | A1 | 12/2014 | Pers et al. |
| 2015/0020887 | A1 | 1/2015 | Poyner et al. |
| 2015/0276455 | A1 | 10/2015 | Trbojevic et al. |
| 2015/0305592 | A1 | 10/2015 | Pers et al. |
| 2018/0132694 | A1 | 5/2018 | Thiyagarajan et al. |

FOREIGN PATENT DOCUMENTS

| | | | |
|---|---|---|---|
| CN | 100502758 | C | 6/2009 |
| CN | 112244709 | A | 1/2021 |
| EP | 2044876 | B1 | 12/2015 |
| WO | WO2005094659 | A1 | 10/2005 |

OTHER PUBLICATIONS

Ganssle, "A Guide to Debouncing", 2008.

*Primary Examiner* — Jason Y Ko
(74) *Attorney, Agent, or Firm* — Dority & Manning, P.A.

(57) ABSTRACT

A method of operating a dishwasher appliance including a drain pump includes detecting a flagged water response state within the dishwasher appliance during a washing operation, ceasing a current cycle segment of the washing operation in response to detecting the flagged water response state, initiating a drain sequence at the drain pump after the current cycle segment has been ceased, determining a next scheduled cycle segment of the washing operation following the current cycle segment in response to initiating the drain sequence, detecting a non-flagged water event following the flagged water response state, and initiating the next scheduled cycle segment of the washing operation in response to detecting the non-flagged water event.

10 Claims, 4 Drawing Sheets

FLAGGED WATER EVENT RESPONSE CYCLE RESUME FOR A DISHWASHER APPLIANCE

FIELD OF THE INVENTION

The present subject matter relates generally to dishwasher appliances, and more particularly to methods and responses for detecting flagged water events in dishwasher appliances.

BACKGROUND OF THE INVENTION

Dishwasher appliances generally include a tub that defines a wash chamber. Rack assemblies can be mounted within the wash chamber of the tub for receipt of articles for washing. Multiple spray assemblies can be positioned within the wash chamber for applying or directing wash fluid towards articles disposed within the rack assemblies in order to clean such articles. Dishwasher appliances are also typically equipped with at least one circulation pump for circulating fluid through the multiple spray assemblies.

Under certain conditions, dishwasher appliances are prone to flooding over a tub lip of the tub. For instance, dishwasher appliances may be prone to flooding over the tub lip during an out-of-level condition, an inlet water valve failure, and/or a drain pump failure. When one or more of such conditions occur, the water level can rise above the designed fill level and spill over the tub lip and onto the floor. This may be detrimental to consumers' homes. Traditionally, when a potential flood is detected within the dishwasher appliance, a washing operation is canceled and the tub is drained. Such current responses are undesirable to consumers, as they may result in unwashed dishes after an assumed complete operation.

Accordingly, a dishwasher appliance which obviates one or more of the above-mentioned drawbacks would be beneficial. In particular, a method for operating a dishwasher appliance including an accurate flagged water event detection or improved flagged water event response action would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a method of operating a dishwasher appliance is provided. The dishwasher appliance may include a drain pump. The method may include detecting a flagged water response state within the dishwasher appliance during a washing operation; ceasing a current cycle segment of the washing operation in response to detecting the flagged water response state; initiating a drain sequence at the drain pump after the current cycle segment has been ceased; determining a next scheduled cycle segment of the washing operation following the current cycle segment in response to initiating the drain sequence; detecting a non-flagged water event following the flagged water response state; and initiating the next scheduled cycle segment of the washing operation in response to detecting the non-flagged water event.

In another exemplary aspect of the present disclosure, a dishwasher appliance is provided. The dishwasher appliance may include a tub; a sump for storing water, the sump being provided at a base of the tub; a drain pump provided in the sump for draining water from the sump; and a controller provided within the dishwasher appliance, the controller configured to initiate a response operation. The response operation may include detecting a flagged water response state within the sump during a washing operation; ceasing a current cycle segment of the washing operation in response to detecting the flagged water response state; initiating a drain sequence after the current cycle segment has been ceased; determining a next scheduled cycle segment of the washing operation following the current cycle segment in response to initiating the drain sequence; detecting a non-flagged water event following the flagged water response state; and initiating the next scheduled cycle segment in response to detecting the non-flagged water event.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
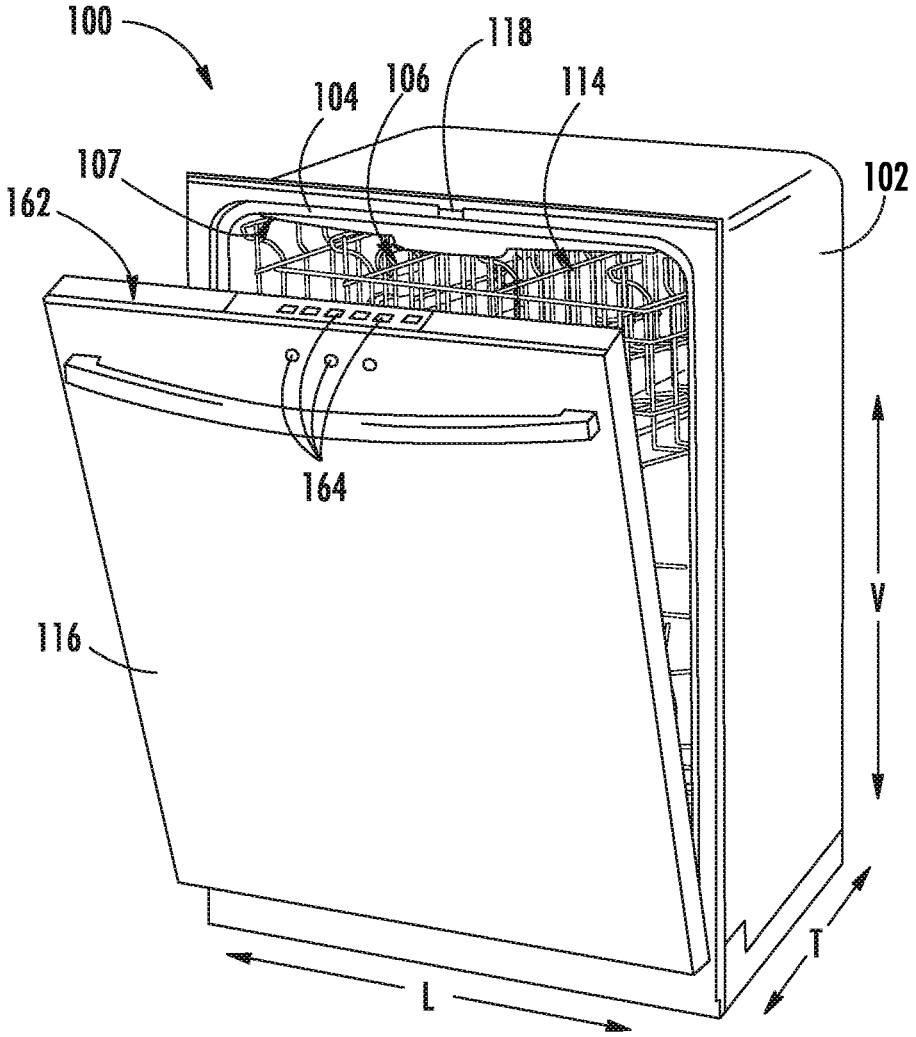
FIG. 1 provides a perspective view of an exemplary embodiment of a dishwasher appliance of the present disclosure with a door in a partially open position.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "article" may refer to, but need not be limited to dishes, pots, pans, silverware, and other cooking utensils and items that can be cleaned in a dishwashing appliance. The term "water circulation cycle" or "water circulation cycle segment" is intended to refer to one or more periods of time during which a dishwashing appliance operates while containing the articles to be washed and uses a detergent and water, preferably with agitation, to e.g., remove soil particles including food and other undesirable elements from the articles. The term "rinse cycle" or "rinse cycle segment" is intended to refer to one or more periods of time during which the dishwashing appliance operates to remove residual soil, detergents, and other undesirable elements that were retained by the articles after completion of the water circulation cycle. The term "drain cycle segment" or "drain sequence" is intended to refer to one or more periods of time during which the dishwashing appliance operates to discharge soiled water from the dishwashing appliance. The term "wash fluid" refers to a liquid used for washing and/or rinsing the articles and is typically made up of water that may include other additives such as detergent or other treatments. Furthermore, as used herein, terms of approximation, such as "approximately," "substantially," or "about," refer to being within a ten percent (10%) margin of error.

Figure 2:
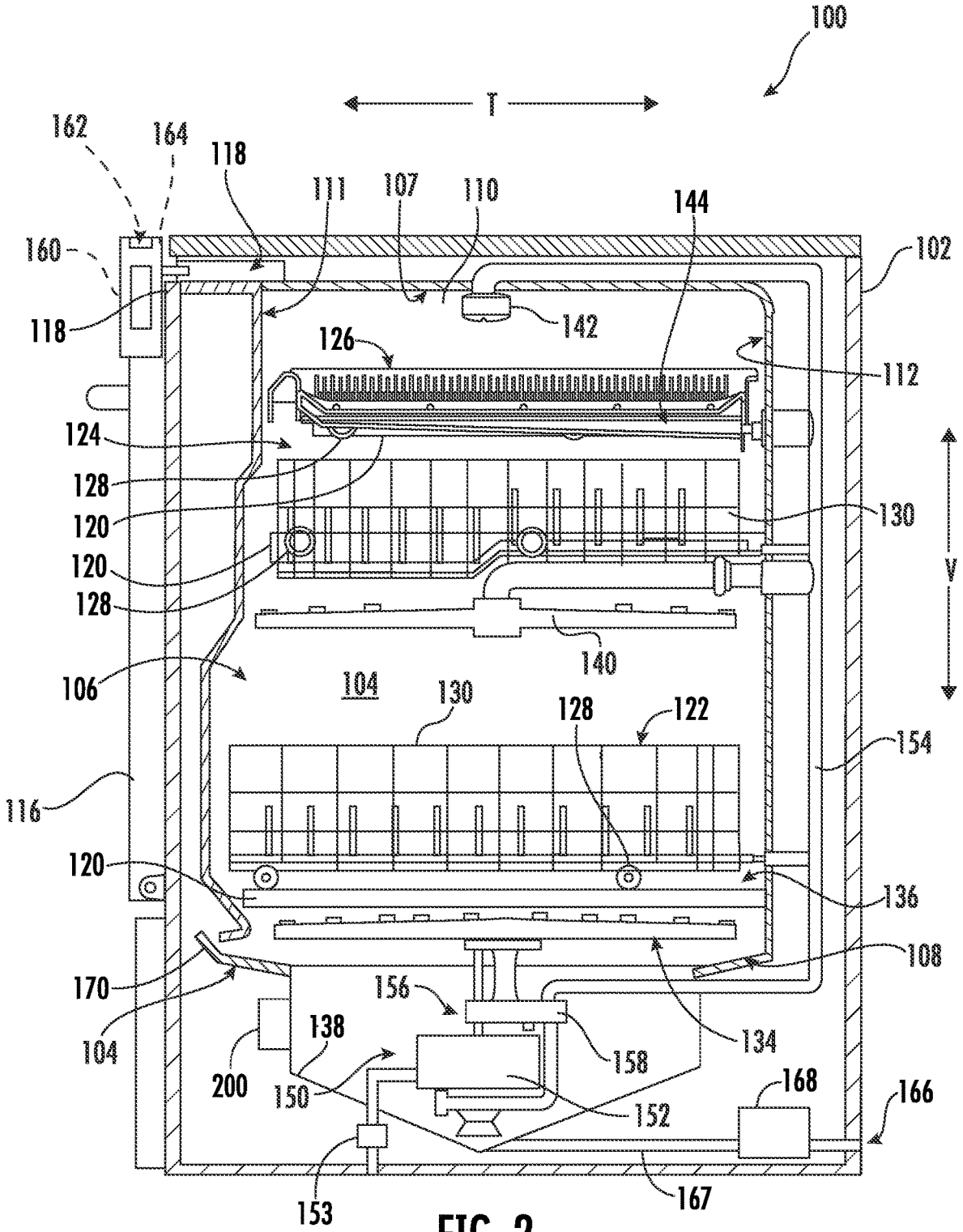
FIG. 2 provides a side, cross sectional view of the exemplary dishwasher appliance of FIG. 1.

FIGS. 1 and 2 depict an exemplary dishwasher or dishwashing appliance 100 that may be configured in accordance with aspects of the present disclosure. For the particular embodiment of FIGS. 1 and 2, dishwasher 100 defines a vertical direction V, a lateral direction L, and a transverse direction T. Each of the vertical direction V, lateral direction L, and transverse direction T are mutually perpendicular to one another and form an orthogonal direction system. Dishwasher 100 includes a cabinet 102 having a tub 104 therein that defines a wash chamber 106. As shown in FIG. 2, tub 104 extends between a top 107 and a bottom 108 along the vertical direction V, between a pair of side walls 110 along the lateral direction L (only one shown in FIG. 2), and between a front side 111 and a rear side 112 along the transverse direction T.

Tub 104 may include a front opening 114 (FIG. 1) and a door 116 hinged at its bottom for movement between a normally closed vertical position (shown in FIG. 2), wherein the wash chamber 106 is sealed shut for washing operation and a horizontal open position for loading and unloading of articles from dishwasher 100. Dishwasher 100 may include a door closure mechanism or assembly 118 that is used to lock and unlock door 116 for accessing and sealing wash chamber 106.

As further shown in FIG. 2, tub side walls 110 may accommodate a plurality of rack assemblies. More specifically, guide rails 120 may be mounted to side walls 110 for supporting a lower rack assembly 122, a middle rack assembly 124, and an upper rack assembly 126. Upper rack assembly 126 may be positioned at a top portion of wash chamber 106 above middle rack assembly 124, which is positioned above lower rack assembly 122 along the vertical direction V. Each rack assembly 122, 124, 126 may be adapted for movement between an extended loading position (not shown) in which the rack is substantially positioned outside the wash chamber 106, and a retracted position (shown in FIGS. 1 and 2) in which the rack is located inside the wash chamber 106. This is facilitated, for example, by rollers 128 mounted onto rack assemblies 122, 124, 126, respectively. Although guide rails 120 and rollers 128 are illustrated herein as facilitating movement of the respective rack assemblies 122, 124, 126, it should be appreciated that any suitable sliding mechanism or member may be used according to alternative embodiments.

Some or all of the rack assemblies 122, 124, 126 are fabricated into lattice structures including a plurality of wires or elongated members 130 (for clarity of illustration, not all elongated members making up rack assemblies 122, 124, 126 are shown in FIG. 2). In this regard, rack assemblies 122, 124, 126 are generally configured for supporting articles within wash chamber 106 while allowing a flow of wash fluid to reach and impinge on those articles during a cleaning or rinsing cycle. According to other exemplary embodiments, a silverware basket (not shown) may be removably attached to a rack assembly (e.g., lower rack assembly 122) for placement of silverware, utensils, and the like, that are otherwise too small to be accommodated by rack 122.

Dishwasher 100 may include a plurality of spray assemblies for urging a flow of water or wash fluid onto the articles placed within wash chamber 106. More specifically, as illustrated in FIG. 2, dishwasher 100 includes a lower spray arm assembly 134 disposed in a lower region 136 of wash chamber 106 and above a sump 138 so as to rotate in relatively close proximity to lower rack assembly 122. Similarly, a mid-level spray arm assembly 140 may be located in an upper region of wash chamber 106 and may be located below and in close proximity to middle rack assembly 124. In this regard, mid-level spray arm assembly 140 is generally configured for urging a flow of wash fluid up through middle rack assembly 124 and upper rack assembly 126. Additionally, an upper spray assembly 142 may be located above upper rack assembly 126 along the vertical direction V. In this manner, upper spray assembly 142 may be configured for urging and/or cascading a flow of wash fluid downward over rack assemblies 122, 124, and 126. As further illustrated in FIG. 2, upper rack assembly 126 may further define an integral spray manifold 144, which is generally configured for urging a flow of wash fluid substantially upward along the vertical direction V through upper rack assembly 126.

The various spray assemblies and manifolds described herein may be part of a fluid distribution system or fluid circulation assembly 150 for circulating water and wash fluid in tub 104. More specifically, fluid circulation assembly 150 may include a circulation pump 152 for circulating water and wash fluid (e.g., detergent, water, and/or rinse aid) in tub 104. Circulation pump 152 may be located within sump 138 or within a machinery compartment located below sump 138 of tub 104. Circulation pump 152 may be in fluid communication with an external water supply line (not shown) and sump 138. A water inlet valve 153 may be positioned between the external water supply line and circulation pump 152 to selectively allow water to flow from the external water supply line to circulation pump 152. Additionally or alternatively, water inlet valve 153 may be positioned between the external water supply line and sump 138 to selectively allow water to flow from the external water supply line to sump 138. Water inlet valve 153 may be selectively controlled to open to allow the flow of water into dishwasher 100 and can be selectively controlled to cease the flow of water into dishwasher 100. Further, fluid circulation assembly 150 may include one or more fluid conduits or circulation piping for directing water and/or wash fluid from circulation pump 152 to the various spray assemblies and manifolds. For example, for the embodiment depicted in FIG. 2, a primary supply conduit 154 extends from circulation pump 152, along rear 112 of tub 104 along the vertical direction V to supply wash fluid throughout wash chamber 106.

As further illustrated in FIG. 2, primary supply conduit 154 may be used to supply wash fluid to one or more spray assemblies (e.g., to mid-level spray arm assembly 140 and upper spray assembly 142). However, it should be appreciated that according to alternative embodiments, any other suitable plumbing configuration may be used to supply wash fluid throughout the various spray manifolds and assemblies described herein. For example, according to another exemplary embodiment, primary supply conduit 154 could be used to provide wash fluid to mid-level spray arm assembly 140 and a dedicated secondary supply conduit (not shown) could be utilized to provide wash fluid to upper spray assembly 142. Other plumbing configurations may be used for providing wash fluid to the various spray devices and manifolds at any location within dishwasher appliance 100.

Each spray arm assembly 134, 140, 142, integral spray manifold 144, or other spray device may include an arrangement of discharge ports or orifices for directing wash fluid received from circulation pump 152 onto dishes or other articles located in wash chamber 106. The arrangement of the discharge ports, also referred to as jets, apertures, or orifices, may provide a rotational force by virtue of wash fluid flowing through the discharge ports. Additionally or alternatively, spray arm assemblies 134, 140, 142 may be motor-driven, or may operate using any other suitable drive mechanism. Spray manifolds and assemblies may also be stationary. The resultant movement of the spray arm assemblies 134, 140, 142 and the spray from fixed manifolds may provide coverage of dishes and other dishwasher contents with a washing spray. Other configurations of spray assemblies may be used as well. For instance, dishwasher 100 may have additional spray assemblies for cleaning silverware, for scouring casserole dishes, for spraying pots and pans, for cleaning bottles, etc.

In operation, circulation pump 152 may draw wash fluid in from sump 138 and pump it to a diverter 156, e.g., which is positioned within sump 138 of dishwasher appliance. Diverter 156 may include a diverter disk (not shown) disposed within a diverter chamber 158 for selectively distributing the wash fluid to the spray arm assemblies 134, 140, 142 and/or other spray manifolds or devices. For example, the diverter disk may have a plurality of apertures that are configured to align with one or more outlet ports (not shown) at the top of diverter chamber 158. In this manner, the diverter disk may be selectively rotated to provide wash fluid to the desired spray device.

According to an exemplary embodiment, diverter 156 is configured for selectively distributing the flow of wash fluid from circulation pump 152 to various fluid supply conduits, only some of which are illustrated in FIG. 2 for clarity. More specifically, diverter 156 may include four outlet ports (not shown) for supplying wash fluid to a first conduit for rotating lower spray arm assembly 134 in the clockwise direction, a second conduit for rotating lower spray arm assembly 134 in the counter-clockwise direction, a third conduit for spraying an auxiliary rack such as the silverware rack, and a fourth conduit for supply mid-level and/or upper spray assemblies 140, 142, e.g., such as primary supply conduit 154.

Drainage of soiled wash fluid within sump 138 may occur, for example, through drain assembly 166. In particular, wash fluid may exit sump through a drain and may flow through a drain conduit 167. A drain pump 168 may facilitate drainage of the soiled wash fluid by pumping the wash fluid to a drain line external to dishwasher 100.

Dishwasher 100 may be equipped with a controller 160 to regulate operation of dishwasher 100. Controller 160 may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In some embodiments, the processor executes programming instructions stored in memory. The memory may be a separate component from the processor or may be included onboard within the processor. Additionally or alternatively, controller 160 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Controller 160 may be positioned in a variety of locations throughout dishwasher 100. In the illustrated embodiment, controller 160 may be located within a control panel area 162 of door 116 as shown in FIGS. 1 and 2. In such an embodiment, input/output ("I/O") signals may be routed between the control system and various operational components of dishwasher 100 along wiring harnesses that may be routed through the bottom of door 116. Typically, the controller 160 includes a user interface panel/controls 164 through which a user may select various operational features and modes and monitor progress of dishwasher 100. In one embodiment, the user interface 164 represents a general purpose I/O ("GPIO") device or functional block. In one embodiment, the user interface 164 includes input components, such as one or more of a variety of electrical, mechanical or electro-mechanical input devices including rotary dials, push buttons, and touch pads. The user interface 164 may include a display component, such as a digital or analog display device designed to provide operational feedback to a user. The user interface 164 may be in communication with the controller 160 via one or more signal lines or shared communication busses.

It should be appreciated that the invention is not limited to any particular style, model, or configuration of dishwasher 100. The exemplary embodiment depicted in FIGS. 1 and 2 is for illustrative purposes only. For example, different locations may be provided for user interface 164, different configurations may be provided for rack assemblies 122, 124, 126, different spray arm assemblies 134, 140, 142 and spray manifold configurations may be used, and other differences may be applied while remaining within the scope of the present subject matter.

Figure 3:
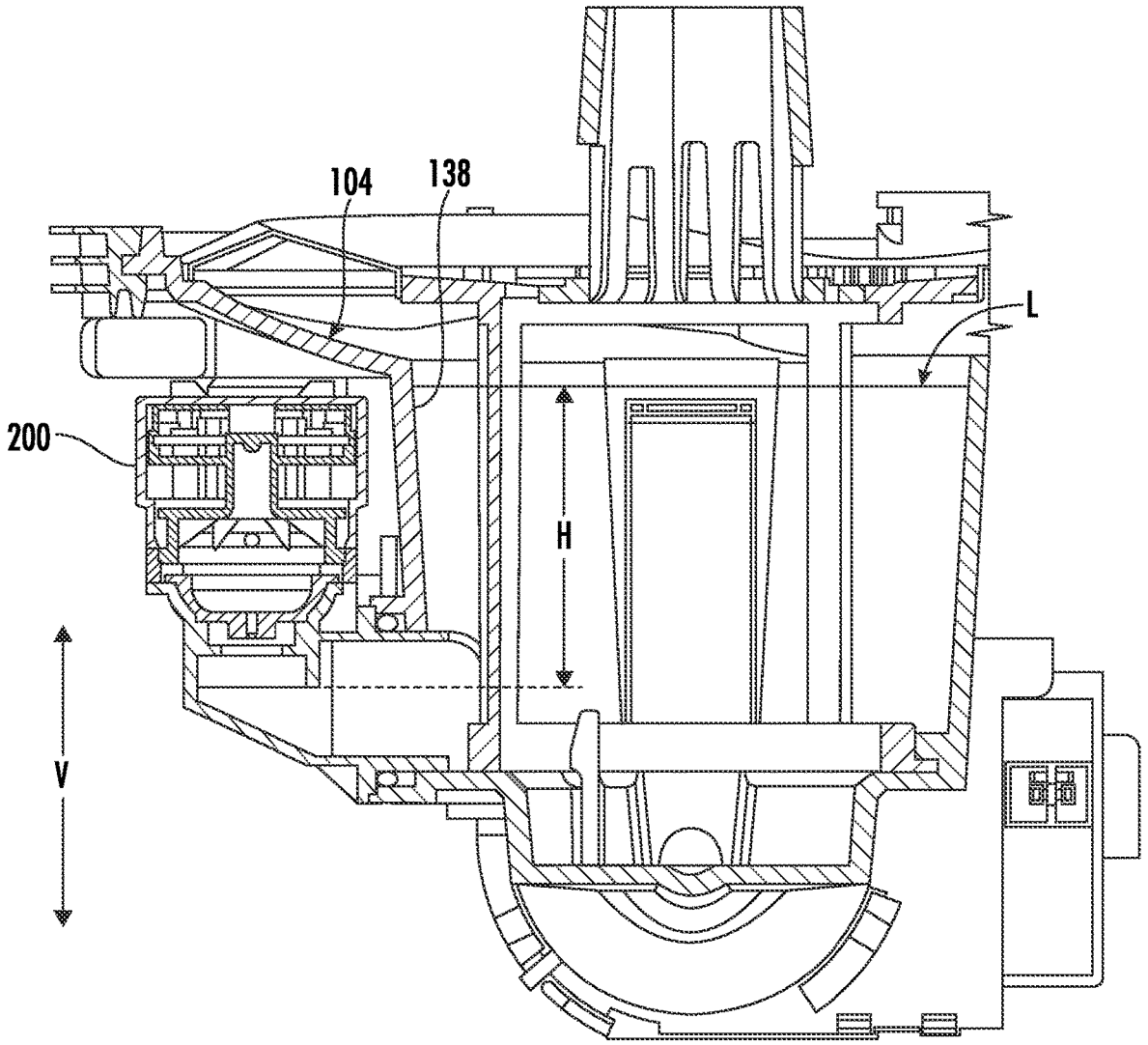
FIG. 3 provides a close-up, cross sectional view of a sump and a pressure sensor of the dishwasher appliance of FIGS. 1 and 2.

FIG. 3 provides a close-up, cross sectional view of sump 138 and a pressure sensor 200 of the dishwasher 100 of FIGS. 1 and 2. In some instances, tub 104 of dishwasher 100 may experience a tub overfill or flagged water event, e.g., when water floods over a tub lip 170 (FIG. 2) of tub 104. An overfill or flagged water event may occur as a result of any number of conditions, such as e.g., an out-of-level condition, an inlet water valve failure, and/or a drain pump failure. Accordingly, in accordance with exemplary aspects of the present disclosure, dishwasher 100 may utilize outputs from pressure sensor 200 to detect and/or prevent flagged water events. It should be appreciated that additional or alternative means for detecting or predicting flagged water events (e.g., a flagged water response state) may be incorporated. For instance, one or more sensors such as optical sensors, humidity sensors, water level sensors, weight sensors, or the like may be included at or near sump 138.

As shown in FIG. 3, pressure sensor 200 may be mounted to sump 138. Pressure sensor 200 may be operatively configured to detect a liquid level L within sump 138 and communicate the liquid level L to controller 160 (FIG. 2) via one or more signals. Thus, pressure sensor 200 and controller 160 may be communicatively coupled. The pressure sensor 200 may send signals to controller 160 as a frequency, as an analog signal, or in another suitable manner or form. Pressure sensor 200 may be any suitable type of sensor capable of sensing the liquid level L within dishwasher 100.

For the depicted embodiment of FIG. 3, pressure sensor 200 is configured to sense the height H of the wash fluid above pressure sensor 200 along the vertical direction V, e.g., by measuring the pressure via pressure sensor 200. In particular, for this embodiment, pressure sensor 200 includes a pressure plate that is acted on by the pressure of the wash fluid within sump 138. As the liquid level L rises, the pressure plate may be pushed upward along the vertical direction V and thus may compress air trapped within the housing and a diaphragm of pressure sensor 200, which causes the diaphragm to flex or alter its position. As a result of the pressure and consequent movement of the diaphragm, a permanent magnet attached to the diaphragm may change its position in relation to a Hall-effect transducer. The transducer delivers one or more electrical signals proportional to the magnetic field of the magnet. The signals may be linearized, digitized, and/or amplified before being sent to controller 160 for processing. Pressure sensor 200 may include a printed circuit board (PCB) board to electrically connect the various electrical components of pressure sensor 200. As noted above, other types of pressure sensors 200 are contemplated.

Figure 4:
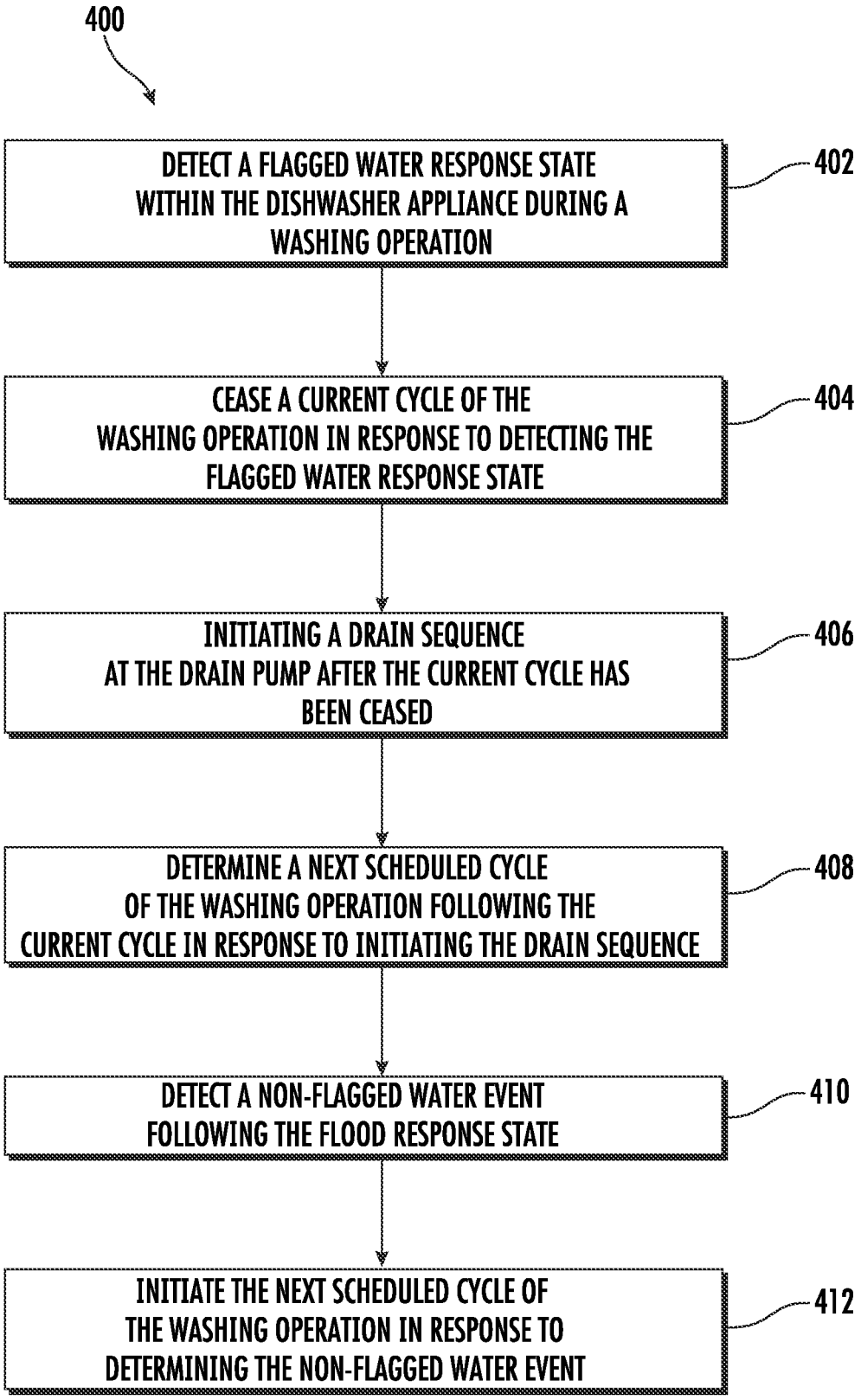
FIG. 4 provides a flow diagram of an exemplary method for detecting a flagged water event according to exemplary embodiments of the present disclosure.

Now that the general descriptions of an exemplary appliance have been described in detail, a method 400 of operating an appliance (e.g., dishwasher appliance 100) will be described in detail. Although the discussion below refers to the exemplary method 400 of operating dishwasher appliance 100, one skilled in the art will appreciate that the exemplary method 400 is applicable to any suitable domestic appliance capable of performing a washing operation. In exemplary embodiments, the various method steps as disclosed herein may be performed by controller 160 and/or a separate, dedicated controller. FIG. 4 provides a flow chart illustrating a method of operating a dishwasher appliance. Hereinafter, method 400 will be described with specific reference to FIG. 4.

At step 402, method 400 may include detecting a flagged water response state within the dishwasher appliance during a washing operation. In detail, a controller (e.g., controller 160) may determine a current state of the dishwasher appliance (e.g., dishwasher appliance 100) via one or more sensors (e.g., pressure sensor 200). For instance, the controller may receive a signal from the pressure sensor indicative of the height of the wash fluid (or water) above the pressure sensor, which is in turn indicative of the liquid level within the sump. The controller may receive the pressure sensor output directly or indirectly from the pressure sensor. The controller may receive pressure sensor outputs continuously at a predetermined interval, such as every tenth of a second, every half second, every second, etc. In this way, the dishwasher appliance may constantly monitor for flagged water events. For example, the pressure sensor outputs are compared against predetermined pressure limits. Additionally or alternatively, the pressure sensor outputs may be analyzed (e.g., within the controller) over a given length of time. The controller may then calculate or determine the level of water within the sump (or within the dishwasher appliance). For one example, a pressure reading of 102 mm/$H_2O$ for 3 seconds triggers a flagged water response state.

The determined water level within the sump may be compared against a predetermined level. The predetermined level may be stored (e.g., within controller) and may be indicative of a flagged water event or a danger of a flagged water event becoming imminent. Thus, the controller may continually compare the detected, determined, or sensed water level against the predetermined level. Once the water level is detected to be above the predetermined level, the flagged water response state may be activated. In detail, the controller may enter a flagged water response state. According to this disclosure, the flagged water response state may include one or more predetermined steps that the dishwasher appliance takes to mitigate potential damage caused by the flagged water event and attempt to determine the cause of the flagged water event trigger (e.g., clogged drain, faulty water valve, etc.).

At step 404, method 400 may include ceasing a current cycle segment of the washing operation in response to determining that the flagged water response state has been triggered. In detail, as described above, the washing operation may include a plurality of individual cycle segments.

The individual cycle segments may include a plurality of water fill cycle segments, a plurality of water circulation cycle segments, one or more rinse cycle segments, or a drying cycle segment. It should be understood that more or fewer cycle segments may be included, such as a plurality of drain cycle segments, one or more detergent supply cycle segments, or the like.

Thus, a current cycle segment of the washing operation may be determined (e.g., via the controller). For instance, the controller may determine that a circulation pump is active, indicating that a water circulation cycle segment is currently being performed. For another example, the controller determines that a water supply valve is in an open state (e.g., such that water is being supplied to the appliance). Thus, the current cycle segment may be (e.g., temporarily) stored (e.g., within an onboard memory). Subsequently, the current cycle segments may be canceled. For example, when the current cycle segment is a water fill cycle segment, the water supply valve may be closed (e.g., immediately after detecting the flagged water response state). Accordingly, the water fill cycle segment is ended, and water is no longer supplied to the appliance.

According to some embodiments, in addition to ceasing the current cycle segment of the washing operation, the method 400 includes deactivating or temporarily disabling a user interface of the dishwasher appliance. For instance, as described above, the user interface (e.g., user interface 164) may include buttons, switches, dials, and display features such as screens, lights, or the like. Thus, upon ceasing the current cycle segment, the appliance (e.g., controller) may disable the user interface such that a user is unable to interact with any of the controls (e.g., inputs, buttons, etc.). Additionally or alternatively, the appliance may deactivate or turn off any lights or display screens provided on the user interface. Accordingly, the user is unable to manipulate the appliance while the flagged water response state is in effect.

At step 406, method 400 may include initiating a drain sequence (e.g., at the drain pump) after the current cycle segment has been ceased. In detail, the appliance may determine that the current cycle segment has been ceased by determining that the circulation pump is inactive, the water valve is closed, or no moving parts (e.g., spray arms) are in motion within the tub of the dishwasher appliance. Subsequently, the drain pump may be activated (i.e., the drain sequence is initiated) to drain or otherwise remove water or wash fluid from the sump. The drain sequence may be similar to a regularly performed drain cycle segment during a normal operation. For instance, the drain pump may be activated under normal operating conditions and a drain valve may be opened.

According to some embodiments, the appliance may initiate a timer (e.g., upon activating the drain pump or detecting the flagged water response state). For instance, the controller on board the dishwasher appliance may include a timer. At the activation of the drain pump, the timer may be initiated. As the controller continually or repeatedly monitors the water level within the sump or appliance (e.g., via the pressure sensor), the timer may keep track of an amount of time for which the drain pump is active, or an amount of time the drain sequence is performed. The timer may be stopped at a conclusion of the drain sequence (e.g., when the drain pump is deactivated or turned off). The elapsed time may then be stored (e.g., within an onboard memory). As will be described in further detail below, the elapsed time of the timer may be compared against a predetermined time limit.

At step 408, method 400 may include determining a next scheduled cycle segment of the washing operation following the current cycle segment in response to initiating the drain sequence. In detail, a subsequent cycle segment following the current cycle segment (e.g., the canceled cycle segment) may be determined (e.g., via the controller). As mentioned above, the cycle segments may include a plurality of water fill cycle segments, a plurality of water circulation cycle segments, and a drying cycle segment (e.g., performed at a conclusion of the washing operation). According to some embodiments, the plurality of water fill cycle segments and the plurality of water circulation cycle segments are performed in an alternating fashion.

For instance, an initial water fill cycle segment may be performed to add an amount of water to the appliance. The initial water fill cycle segment may or may not include detergent. Subsequently, an initial water circulation cycle segment may be performed. The initial water circulation cycle segment may activate the circulation pump to pump the supplied water (and/or detergent) to one or more of the spray arms. At the conclusion of the initial water circulation cycle segment, an intermediate water fill cycle segment may be performed (e.g., supplying a second amount of water to the appliance). Additionally or alternatively, an intervening drain cycle segment or drain sequence may be performed to drain the initial amount of water from the appliance.

Thus, the appliance may determine the next scheduled cycle segment from the current (or canceled) cycle segment. The next scheduled cycle segment may include only water fill cycle segments or drying cycle segments. In detail, the controller may determine that the current (canceled) cycle segment was the initial water fill cycle segment. Accordingly, the following cycle segment would typically be a water circulation cycle segment. Since the flagged water response state has been detected, however, the next scheduled cycle segment moves to the next water fill cycle segment (e.g., the intermediate water fill cycle segment). In the instance where the current (canceled) cycle segment is a final water fill cycle segment, the final water circulation cycle segment would be skipped and the next scheduled cycle segment would be a drying cycle segment. Therefore, the next scheduled cycle segment is one of the plurality of water fill cycle segments or the drying cycle segment.

At step 410, method 400 may include detecting a non-flagged water event (or normal operating condition) following the flagged water event. For instance, after operating the drain pump (e.g., performing the drain phase), the controller may determine that the water level within the appliance (e.g., within the sump) is at an acceptable level (e.g., below the predetermined level). Upon determining that the flagged water response state has been exited, the method 400 may compare the elapsed time taken to reach the non-flagged water event. As described above, the elapsed time is compared against a predetermined time limit. For instance, the predetermined time limit may be about 5 minutes, about 10 minutes, or about 15 minutes. It should be understood that the predetermined time limit may be any suitable amount of time. In the event the elapsed time is less than the predetermined time limit, method 400 proceeds to step 412.

At step 412, method 400 may include initiating the next scheduled cycle segment of the washing operation. In detail, upon determining that the flagged water response state is no longer active (e.g., the non-flagged water event has been detected) and the elapsed time is less than the predetermined time limit, the next scheduled cycle segment may be initiated (e.g., via the controller). As described above, the next scheduled cycle segment is one of a water fill cycle segment or a drying cycle segment. Accordingly, any scheduled water circulation cycle segments, rinse cycle segments, or drain cycle segments are skipped.

In the event that the elapsed time is greater than the predetermined time limit (e.g., the flagged water response state is still in effect after an expiration of the predetermined time), the method 400 may include canceling the washing operation. In detail, the appliance (e.g., controller) may determine that the water level within the sump is not decreasing despite the activation of the drain pump (e.g., the pressure sensor continually detects a pressure of water above a predetermined pressure to indicate a flagged water event). In doing so, the controller may determine that the flagged water event of the dishwasher appliance is not temporary (e.g., as a result of a sensor failure, valve failure, or the like which may be easily resolved through a drain phase). Thus, the appliance may store a fault code (e.g., within an onboard memory) and cancel the washing operation. Additionally or alternatively, the appliance may alert a user of the fault code.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher appliance comprising:

a tub;

a sump for storing water, the sump being provided at a base of the tub;

a drain pump provided in the sump for draining water from the sump; and a controller provided within the dishwasher appliance, the controller configured to initiate a response operation, the response operation comprising:

detecting a flagged water response state within the sump during a washing operation;

ceasing a current cycle segment of the washing operation in response to detecting the flagged water response state;

initiating a drain sequence after the current cycle segment has been ceased;

determining a next scheduled cycle segment of the washing operation following the current cycle segment in response to initiating the drain sequence;

detecting a non-flagged water event following the flagged water response state; and initiating the next scheduled cycle segment in response to detecting the non-flagged water event.

2. The dishwasher appliance of claim 1, wherein the washing operation comprises:

a plurality of water fill cycle segments;

a plurality of water circulation cycle segments; and a drying cycle segment, wherein the plurality of water fill cycle segments and the plurality of water circulation cycle segments are performed in an alternating fashion.

3. The dishwasher appliance of claim 2, wherein the next scheduled cycle segment of the washing operation is one of the plurality of water fill cycle segments or the drying cycle segment.

4. The dishwasher appliance of claim 2, wherein the current cycle segment is an intermediate water fill cycle segment of the plurality of water fill cycle segments, and the next scheduled cycle segment is a subsequent water fill cycle segment.

5. The dishwasher appliance of claim 2, wherein the current cycle segment is a final water fill cycle segment of the plurality of water fill cycle segments, and the next scheduled cycle segment is the drying cycle segment.

6. The dishwasher appliance of claim 1, wherein detecting the flagged water response state comprises determining that a level of water within the sump is above a predetermined level.

7. The dishwasher appliance of claim 6, further comprising:

a pressure sensor configured to determine a pressure of water within the sump, wherein determining that the level of water within the dishwasher appliance is above the predetermined level comprises determining the pressure of water via the pressure sensor is above a predetermined pressure.

8. The dishwasher appliance of claim 1, wherein the response operation further comprises:

initiating a timer in response to detecting the flagged water response state; and determining that an elapsed time of the timer is less than a predetermined time limit after performing the drain sequence, wherein the next scheduled cycle segment is initiated only after determining that the elapsed time of the timer is less than the predetermined time limit.

9. The dishwasher appliance of claim 1, wherein the response operation further comprises:

initiating a timer in response to detecting the flagged water response state;

determining that an elapsed time of the timer is greater than a predetermined time limit after performing the drain sequence; and canceling the washing operation in response to determining that the elapsed time of the timer is greater than the predetermined time limit.

10. The dishwasher appliance of claim 1, further comprising:

a user interface, the response operation further comprising:

disabling the user interface in response to determining that the flagged water response state has been triggered.

* * * * *